US005581591A

United States Patent [19]

Burke et al.

[11] Patent Number: 5,581,591

[45] Date of Patent: Dec. 3, 1996

[54] FOCAL SPOT MOTION CONTROL FOR ROTATING HOUSING AND ANODE/STATIONARY CATHODE X-RAY TUBES

[75] Inventors: James E. Burke, Glenview; Lester Miller, Naperville; Salvatore Perno, Winfield; Norman E. Wandke, Naperville, all of Ill.

[73] Assignee: Picker International, Inc., Highland Heights, Ohio

[21] Appl. No.: 345,921

[22] Filed: Nov. 28, 1994

Related U.S. Application Data

[63] Continuation-in-part of Ser. No. 93,055, Jul. 16, 1993, Pat. No. 5,384,820, which is a continuation-in-part of Ser. No. 988,403, Dec. 9, 1992, Pat. No. 5,274,690, which is a continuation-in-part of Ser. No. 817,294, Jan. 6, 1992, Pat. No. 5,241,577, and a continuation-in-part of Ser. No. 817,295, Jan. 6, 1992, Pat. No. 5,200,985, and a continuation-in-part of Ser. No. 817,296, Jan. 6, 1992, abandoned, and a continuation-in-part of Ser. No. 862,805, Apr. 3, 1992, Pat. No. 5,268,955.

[51] Int. Cl.[6] ..... H01J 35/04

[52] U.S. Cl. ..... 378/135; 378/137

[58] Field of Search ..... 378/93, 94, 113, 378/121, 125, 126, 135, 136, 137, 138, 143, 144

[56] References Cited

U.S. PATENT DOCUMENTS

| | | | |
|---|---|---|---|
| 2,926,270 | 2/1960 | Zunick | 378/126 |
| 3,689,790 | 9/1972 | Haas et al. | 378/126 |
| 3,714,487 | 1/1973 | Jacob | 378/135 |
| 4,675,891 | 6/1987 | Plessis et al. | 378/135 X |
| 4,878,235 | 10/1989 | Anderson | 378/136 |
| 4,993,055 | 2/1991 | Rand et al. | 378/137 X |
| 5,065,420 | 11/1991 | Levere | 378/137 |

*Primary Examiner*—David P. Porta

*Attorney, Agent, or Firm*—Fay, Sharpe, Beall, Fagan, Minnich & McKee

[57] ABSTRACT

An x-ray tube includes an anode (A) and an envelope (C). A cathode assembly (B) which is supported in the envelope on a bearing (32) emits a beam of electrons which strike the anode forming a focal spot. The anode rotates (D) relative to the cathode such that focal spot follows a generally annular path along a beveled track (14). If the axis of the anode and the cathode assembly are screwed or offset, the focal spot path is not circular and wobbles. An adjustment assembly (60) adjusts the relative positions of the anode, the cathode and the envelope to adjust the anode and cathode assembly axes. The adjustment assembly also includes one or more electrodes (102, 108) which adjust the position of the focal spot. An angular position encoder (106) identifies an angular orientation of the anode. A control circuit (110) applies an electrostatic potential to the electrodes to move the focal spot such that it stays on a constant plane of the leveled anode surface.

9 Claims, 8 Drawing Sheets

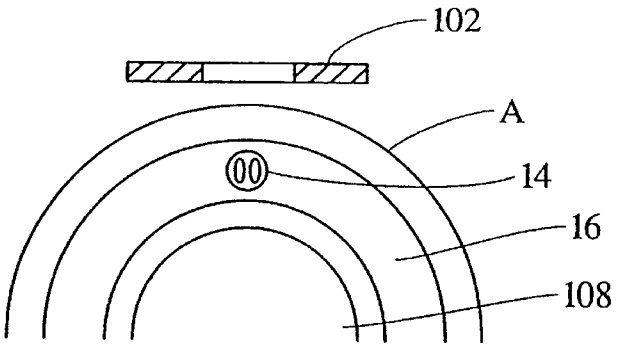
Fig.6
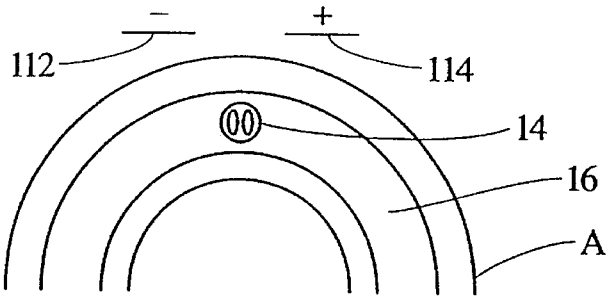
Fig.7
Fig.8
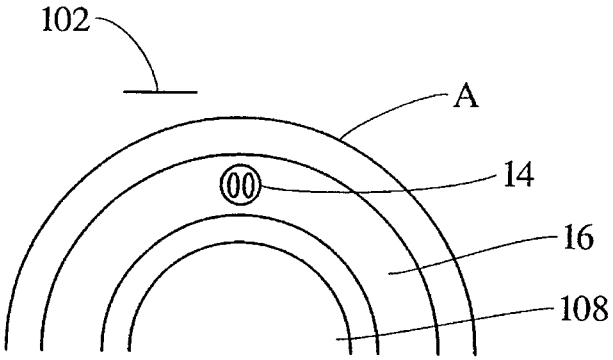
Fig.9

FOCAL SPOT MOTION CONTROL FOR ROTATING HOUSING AND ANODE/STATIONARY CATHODE X-RAY TUBES

This application is a continuation-in-part of U.S. application Ser. No. 08/093,055 filed Jul. 16, 1993, now U.S. Pat. No. 5,384,820, which is a continuation-in-part of U.S. application Ser. No. 07/988,403 filed Dec. 9, 1992, now U.S. Pat. No. 5,274,690, which, in turn, is a continuation-in-part of U.S. application Ser. Nos. 07/817,294,now U.S. Pat. No. 5,241,977; 07/817,295, now U.S. Pat. No. 5,200,985; and 07/817,296, now abandoned, all filed Jan. 6, 1992, and U.S. application Ser. No. 07/862,805 filed Apr. 3, 1992, U.S. Pat. No. 5,268,955.

BACKGROUND OF THE INVENTION

The present invention relates to the x-ray tube art. It finds particular application in conjunction with high power x-ray tubes for use with CT scanners and the like and will be described with particular reference thereto. It will be appreciated, however, that the invention will also have other applications.

Typically, a high power x-ray tube includes an evacuated envelope or housing which holds a cathode filament through which a heating or filament current is passed. This current heats the filament sufficiently that a cloud of electrons is emitted, i.e. thermionic emission occurs. A high potential, typically on the order of 100–200 kV, is applied between the cathode and an anode which is also located in the evacuated envelope. This potential causes a tube current of electrons to flow from the cathode to the anode through the evacuated region in the interior of the evacuated envelope. The electron beam impinges on a small area, or focal spot, of the anode with sufficient energy that x-rays are generated and extreme heat is produced as a byproduct.

In high energy x-ray tubes, the anode is rotated at a high speed such that the electron beam does not dwell on only the small spot of the anode long enough to cause thermal deformation. The diameter of the anode is sufficiently large that in one rotation of the anode, each spot on the anode that was heated by the electron beam has substantially cooled before returning to be reheated by the electron beam. Larger diameter anodes have larger circumferences, hence provide greater thermal loading.

In conventional rotating anode x-ray tubes, the envelope and the cathode remain stationary while the anode rotates inside the envelope. Heat from the anode is dissipated by the thermal radiation through the vacuum to the exterior of the vacuum envelope. It is to be appreciated that heat transfer from the anode through the vacuum is limited.

High power x-ray tubes have been proposed in which the anode and vacuum envelope rotate, while the cathode filament inside the envelope remains stationary. This configuration permits a coolant fluid to circulate in directed contact with the anode to provide a direct thermal communication between the anode and the exterior of the envelope. See for example, U.S. Pat. Nos. 5,046,186; 4,788,705; 4,878,235; and 2,111,412.

More specifically, an outer housing is provided which has the window through which x-rays emerge. The anode and vacuum envelope are rotatably mounted within the housing and displaced a significant distance therefrom. The chamber between the housing and the vacuum envelope is filled with a coolant oil. Connections are provided on the housing for withdrawing oil, pumping it through a radiator or other cooling system, and returning the cooled oil to the housing. When x-rays are generated at the focal point on the anode, x-rays are emitted in substantially all directions. Because the anode has a high x-ray blocking power x-rays are effectively emitted over a basically hemispherical volume defined over the focal point where the electron beam from the cathode strikes the anode surface. These high energy x-rays pass through the vacuum envelope into the coolant oil. The coolant oil is highly radiation transparent such that x-rays passes through the oil in the reservoir to the window without significant attenuation.

One of the difficulties with this configuration is focal spot motion. Focal spot motion can arise from at least two sources in this tube type. A first source is a lack of alignment between the cathode bearing structure and the target axle, which is typically aligned with the target track surface. Parallel displacement of the cathode bearing and angular shift contribute to this misalignment and cause the focal spot to wander across or deviate from the track in a one per revolution period path.

Misalignment is caused primarily by assembly tolerance stack up and stresses built up during the welding process. Practically speaking, current technology dictates that although misalignment can be managed, it cannot be eliminated.

Thus, it becomes increasingly important to control misalignment, especially where smaller focal spot sizes and thinner slice widths are desired. Specifically, focal spot motion produces a larger apparent spot size and may give rise to artifacts as the spot moves in and out of the plane.

Accordingly, although the magnitude of focal spot motion is somewhat less than simple mechanical considerations would indicate due to the effect of electron optics in the tube, a significant problem is generated with respect to image reconstruction.

A second source of undesired focal spot motion is oscillation of the focal spot due to mechanical vibration of the tube. One type of vibration is torsional about the cathode bearing axis, with the magnets providing the restoring force. The plates, tubes, and axle of the cathode assembly also vibrate. It would be advantageous to reduce the magnitude of these vibrations or at least be able to realign the assembly conveniently after the vibration to control the focal spot motion.

The present invention provides a new and improved construction which overcomes the above-referenced problems and others.

SUMMARY OF THE INVENTION

In accordance with the present invention, an x-ray tube is provided in which an evacuated envelope and a cathode contained therein undergo relative rotational movement. The x-ray tube is adapted to generate x-rays from emission of electrons onto a focal spot of the anode. Adjustment of the focal spot is achieved using an adjustment assembly provided to the x-ray tube.

In accordance with another aspect of the invention, the adjustment assembly comprises cylindrical plates and adjusting and locking/set screws.

In accordance with a more limited aspect of the invention, a flexible bellows member is used in connection with the adjustment assembly to facilitate relative movement of the cathode, evacuated envelope, and anode, yet maintain a vacuum state in the envelope. The relative movement consequently affects the focal spot position.

In accordance with another aspect of the invention, the adjustment assembly comprises at least one plate upon which a charge is developed to vary the position of the x-ray beam and/or focal spot electrostatically.

One advantage of the present invention is that focal spot motion is controlled.

Another advantage of the present invention is management of misalignment.

Another advantage of the present invention is that focal spot size is controlled and, thus, artifacts in the image are reduced.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

FIG. 6 is a partial cross-sectional view along line 6—6 of FIG. 5;

FIG. 7 is a partial cross-sectional view of a variation of the x-ray tube of FIG. 5;

FIG. 8 is a partial cross-sectional view of a variation of the x-ray tube of FIG. 5;

FIG. 9 is a partial cross-sectional view of a variation of the x-ray tube of FIG. 5;

DETAILED DESCRIPTION OF THE PREFERRED EMBODIMENTS

Figure 1:
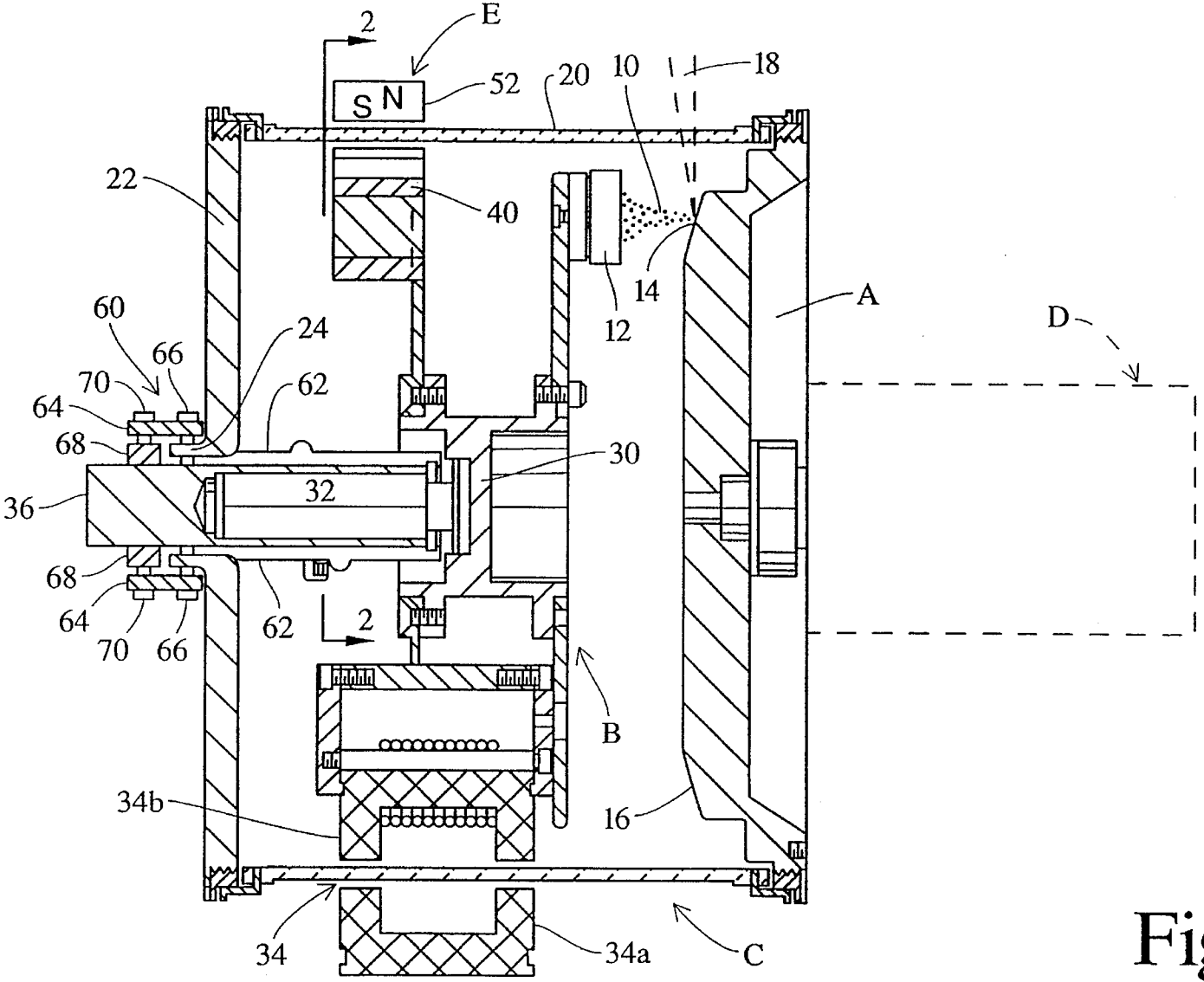
FIG. 1 is a cross-sectional view of one embodiment of the x-ray tube of the present invention.

With reference to FIG. 1, an x-ray tube includes an anode A and a cathode assembly B. An evacuated envelope C is evacuated such that an electron beam 10 can pass from a cathode cup 12 to a focal spot 14 on an annular face 16 of the anode. A rotational driver D rotates the anode A and the evacuated envelope C while a magnetic susceptor assembly E holds the cathode assembly B stationary.

The anode A is beveled adjacent its annular peripheral edge to define the anode surface 16 which is bombarded by the electron beam 10 to generate a beam 18 of x-rays. The entire anode may be machined from a single piece of tungsten. Alternately, the focal spot path along the anode surface may be defined by an annular strip of tungsten which is connected to a highly thermally conductive disk or plate. Preferably, the anode and envelope are immersed in an oil-based dielectric fluid which is circulated to a cooling means. In order to keep the face 16 of the anode cool, portions of the anode between the cooling fluid are highly thermally conductive.

The anode assembly A forms one end of the vacuum envelope C. A ceramic cylinder 20 is connected between the anode and an opposite or cathode end plate 22. The end plate 22 includes a collar 24 defining a circumferential aperture therein.

At least an annular portion of the cylinder 20 closely adjacent to the anode is x-ray transparent to provide a window from which the x-ray beam 18 is emitted. Preferably, the cylinder 20 is constructed at least in part of a dielectric material such that the high voltage differential is maintained between the anode A and the end plate 22. In the preferred embodiment, the end plate is biased to the potential of the cathode assembly B, generally about 100–200 kV more negative than the anode A.

The cathode assembly B includes a cathode hub 30 which is rotatably mounted by a bearing 32 relative to the cathode plate 22. The cathode cup 12 is mounted on a peripheral extension of the cathode hub. The cathode cup 12 includes a filament or other source of electrons. The cathode cup, specifically the filament, is electrically connected with a filament drive transformer assembly 34.

An exterior transformer winding **34*a* is connected with a filament power supply which controls the amount of current passing through the cathode filament, and hence controls the thermionic emission. A stationary transformer winding 34*b* is mounted directly across the ceramic envelope wall 20 in a magnetically coupled relationship therewith. The interior transformer winding 34*b* is electrically connected across the cathode filament. Optionally, a plurality of cathode cups or filaments may be provided. The additional cathode cups may be used for producing different types of electrode beams, such as beams with a broader or narrower focal spot, higher or lower energy beams, or the like. Also, additional cathode cups may function as a back up in case the first cup should fail or burn out. An externally controllable electronic switching circuit (not shown) can be provided between the internal transformer winding 34*b*** and the cathode cups to enable selection of which cathode cup receives the power from the transformer. Other means may also be used for transferring power to the filament such as a capacitive coupling or an annular transformer that is disposed adjacent the susceptor assembly E.

Also shown is cathode bearing shaft 36. The shaft 36 is received in the collar 24 and receivingly connects to bearing 32.

Figure 2:
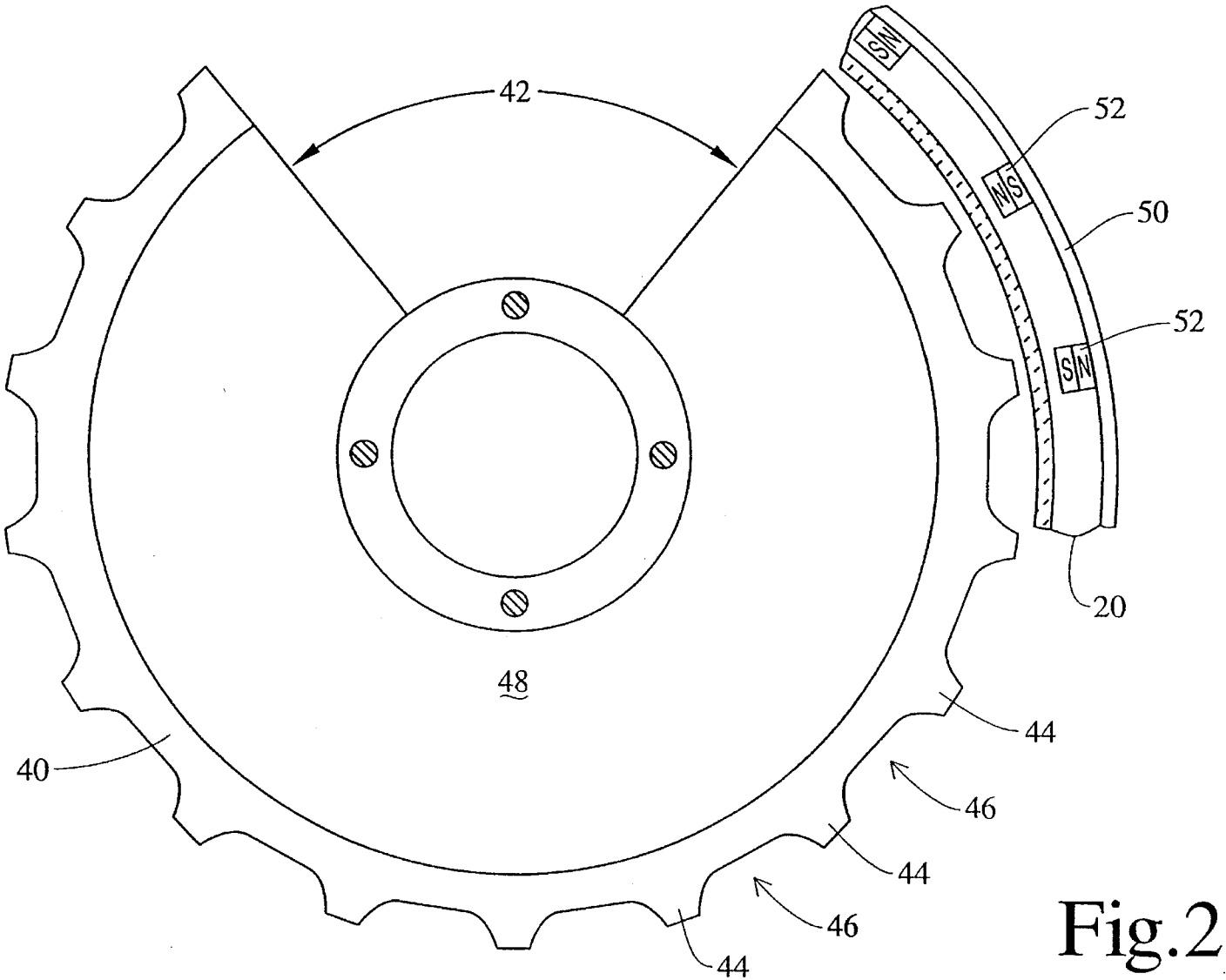
FIG. 2 is a view along line 2-2 of FIG. 1.

With continuing reference to FIG. 1 and further reference to FIG. 2, the magnetic susceptor assembly E includes a susceptor 40 which follows the cylindrical inner surface of the envelope. The cylindrical contour of the susceptor may be broken out or discontinuous to accommodate other structures within the x-ray tube. For example, the susceptor has an arc segment 42 removed in order to accommodate the filament transformer 34. The susceptor has alternating teeth or projections 44 and valleys or recesses 46. The susceptor is mounted on a lever arm means such a disk portion 48 which holds the teeth portions of a magnetic susceptor at the maximum possible lever arm radius permitted by the envelope 20. The susceptor portion is constructed of a material with high magnetic susceptibility even at the elevated temperatures found in an x-ray tube.

A keeper or other frame structure 50 is rigidly mounted around the exterior of the envelope. A plurality of magnets 52, preferably high strength permanent magnets, are positioned opposite each of the magnetic susceptor teeth portions. Due to the higher operating temperatures associated with x-ray tubes, the magnets are constructed of a material with a high curie temperature, such as Alnico 8, neodymium-iron-boron, samarium-cobalt, or other high temperature permanent magnets. The magnets 52 are mounted to the keeper 50 such that adjacent magnets have opposite polarity faces disposed towards the magnetic susceptor 40. This causes magnetic flux paths 54 to be formed through the magnetic susceptor between adjacent magnets.

Referring again now to only FIG. 1, an adjustment assembly 60 and a flexible member, or bellows, 62 adjust concentricity of the axes of the hub 30 and the envelope 20. The bellows 62 connects the cathode end plate 22, i.e., collar 24, to the shaft 36 that has a bore in which the bearing 32 is mounted. The bellows maintain the vacuum in the envelope C by providing a flexible vacuum seal between the end plate 22 and the shaft 36. While the shaft 36 is received by the collar 24, and may well fit snugly, a vacuum seal between these components is not assured. The bellows 62 is connected between the end plate 22 and the shaft 36 to provide a flexible vacuum tight seal therebetween.

The adjustment assembly 60 includes a cylindrical portion 64 which is integrally or fixedly connected with the end plate 22. One or more screws 66 extend through the cylindrical portion into contact with the shaft 36 to prevent the shaft from moving axially and provide pivot points. An eccentric ring 68 is rotatably received between the cylindrical portion 64 and the shaft 36. The shaft is received off center in the ring such that rotating the ring rotates the axis of shaft 36 eccentrically. Adjustment screws 70 selectively fix the rotational position of the eccentric ring 68 when the shaft central axis and a central axis of the cylinder are angularly aligned.

Preferably, there are three set screws 66 at 120° intervals. Selective rotation of the set screws 66 relative to the collar shifts the axes of the cylinder 20 and the shaft 36. Thus, the set screws 66 adjust the relative position of the axes and the eccentric ring and adjustment screws adjust the relative or angular orientation of the axes.

Alternately the eccentric ring may be eliminated in favor of three adjustment screws 70. Adjusting the adjustment and set screws together shifts the relative position of the axes. Adjusting the adjustment and set screws to different degrees adjusts the relative orientation (and usually position) of the axes.

Figure 3:
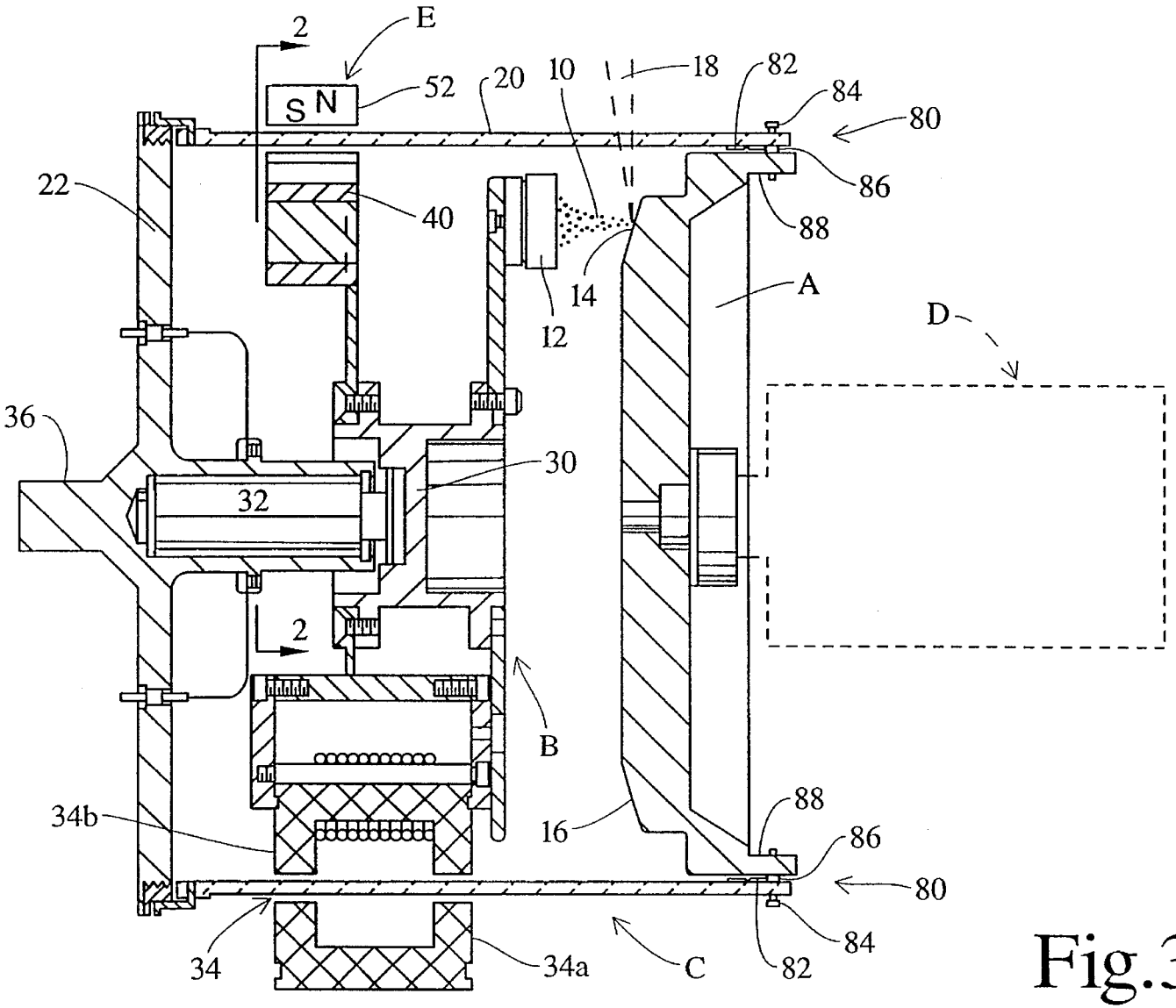
FIG. 3 is a cross-sectional view of a further embodiment of the present invention.

In the embodiment of FIG. 3, the axis of the anode A is adjusted relative to the central orientation axis of the cylinder 20. An adjustment assembly 80 includes adjustment screws 84, an annular ring eccentric 86, and an anode extension 88. A bellows 82 is an annular flexible member which connects the cylinder 20 to the ring 86 which, in turn is connected with a vacuum tight connection to the anode extension to maintain the vacuum in the envelope C. The eccentric ring is rotated to adjust the relative position of the cylinder 20 to the anode A to adjust or realign their axes. The adjustment assembly 80 which adjusts the relative position of the axes of the anode and the cylinder 20 can be used in combination with the adjustment assembly 60 which adjusts the relative position and orientation of the axes of the cylinder 20 and the hub 30.

Figure 4:
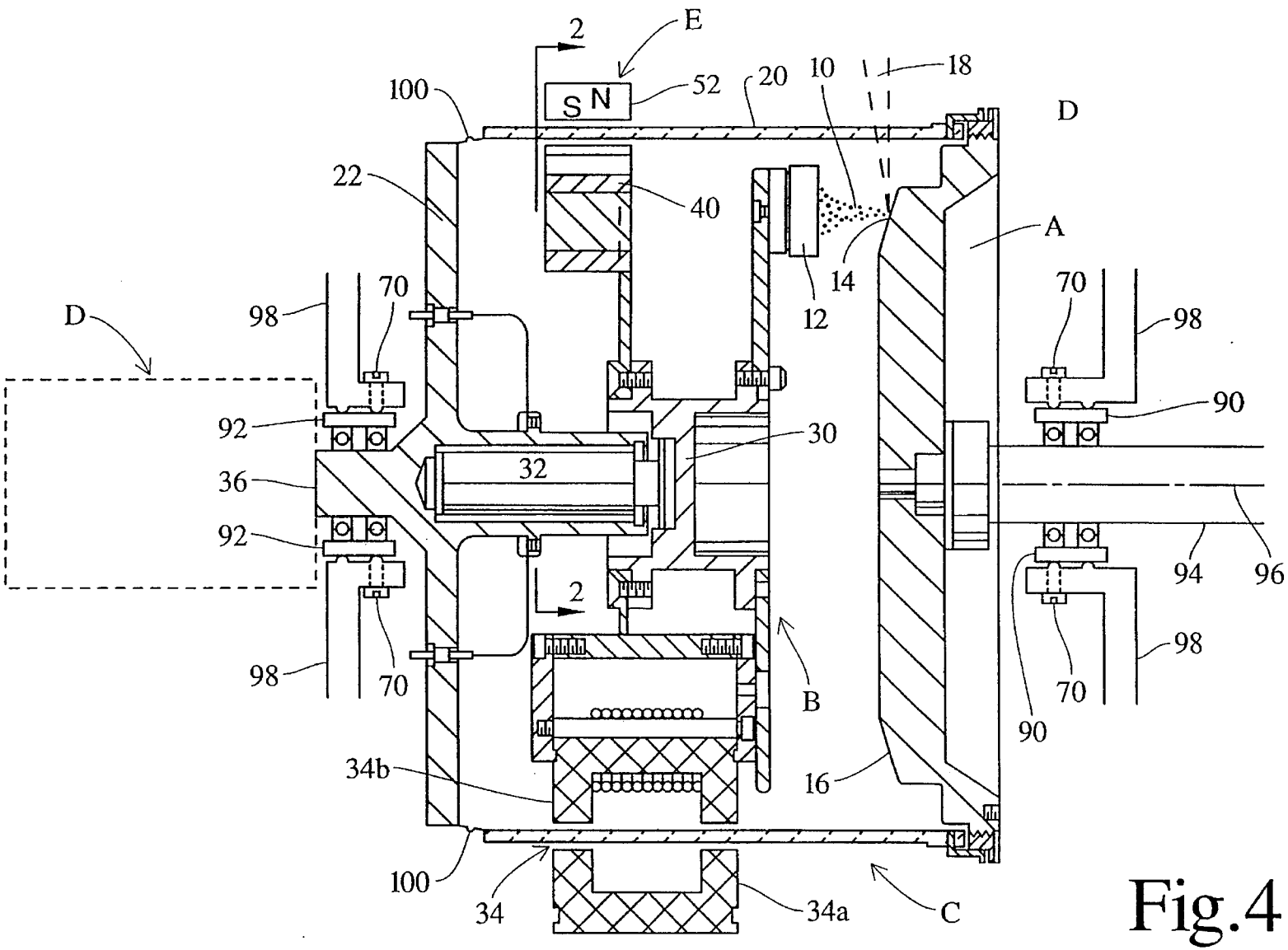
FIG. 4 is a cross-sectional view of a further embodiment of the present invention.

Referring now to FIG. 4, precisely aligned bearings 90 and 92 located on each side of the x-ray tube serve to maintain and adjust alignment of the cathode, envelope, and anode. More specifically, bearing 90 is provided to stabilize a shaft 94 which is rigidly connected to the anode A. The bearing allows rotation of the shaft 94 and the anode about a central axis of the shaft 96. The bearing 92 is likewise disposed on the shaft 36 to provide stability and rotation. The bearings 90 and 92 are received in an outer housing 98 or other associated structure. Adjustment screws 70 or other adjustment structures are again provided to adjust the position and orientation of the central axes of the shafts 36, 94, hence of the cathode hub and the anode. A flexible bellows 100 facilitates maintenance of the vacuum state in the envelope C. Due to its flexible nature, the bellows allows for adjustment of the constituent elements of the x-ray tube.

Thus far, the present invention has been described in connection with mechanical adjustment assemblies. However, the adjustment assembly is also realized by taking advantage of known electrostatic principles. For example, electrical devices are used to vary the electric fields associated with the tube to vary the position and focus of the beam and, consequently, the focal spot.

Figure 5:
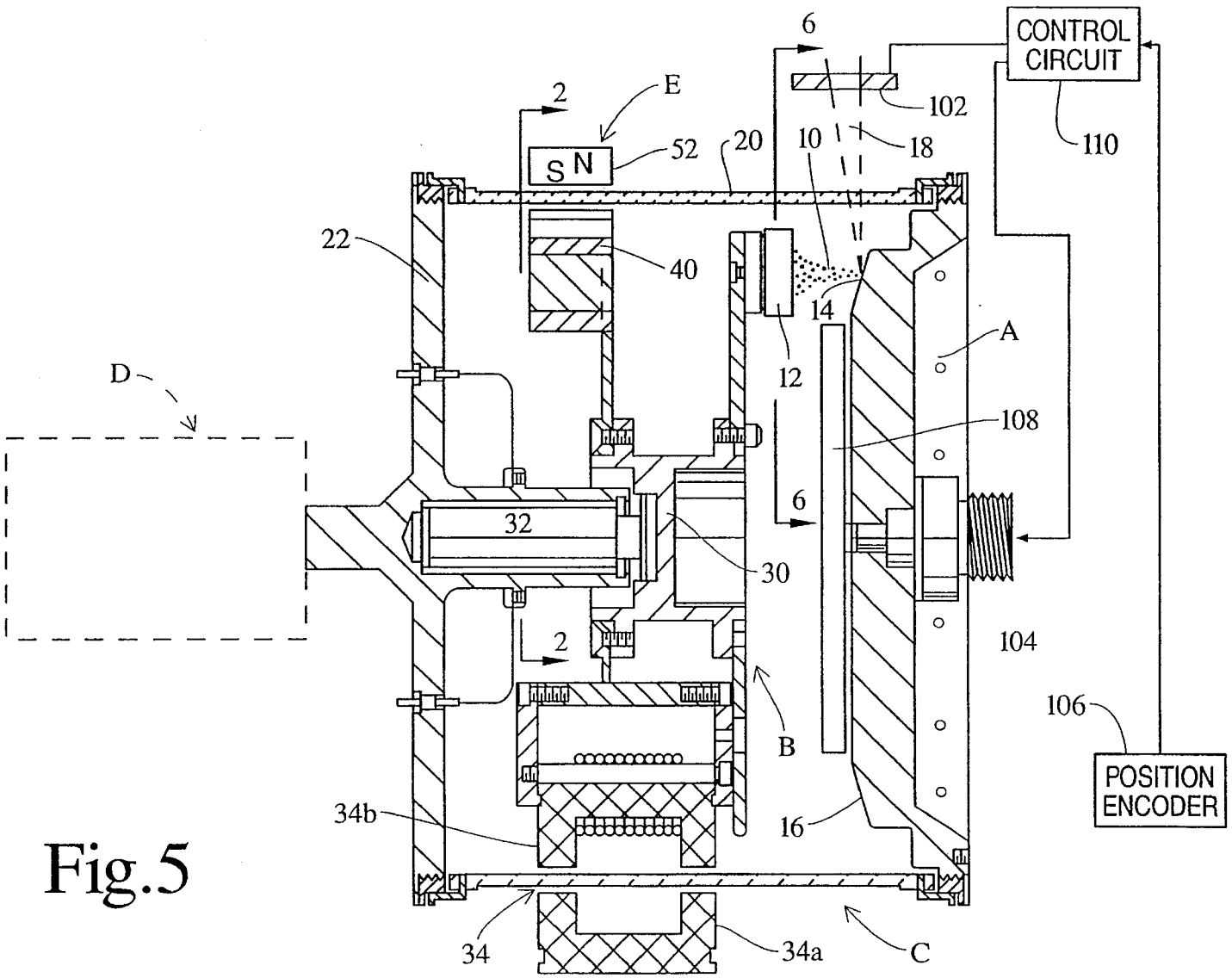
FIG. 5 is a cross-sectional view of a further embodiment of the present invention.

With reference to FIGS. 5 and 6, a further embodiment of the present invention is shown utilizing such electrostatic principles. An external x-ray transparent plate or cylindrical sector 102 is disposed externally of the x-ray tube. The plates can be rendered x-ray transparent by removing a slot sized to pass the beam. An AC voltage is pressed upon plate 102 to attract or repel the beam 18 according to desired positioning of the beam. Rotational position information, generated using position markers 104 on the anode A, is monitored by a position encoder 106 to assure proper timing.

An internal plate or cylinder 108 is insulated from the target and operates in conjunction with the external plate 102 to attract or repel the beam. A control circuit 110 adjusts the potential across the external plate 102 and the internal plate 108 in accordance with the angular position of the anode to control the focal spot and remove unwanted focal spot motion. Alternatively, the cathode is utilized to provide this function. However, an internal structure, such as plate 108, is not necessary to control of the focal spot motion.

FIGS. 7 and 8 illustrate two configurations providing side-to-side correction of the focal spot position. The internal and external plate pair achieve a radial adjustment. A pair of external electrodes 112, 114 positioned leading and trailing the focal spot are oppositely charged to attract and repel the beam. This pushes and pulls the beam with radial and circumferential positional adjustments.

In the embodiment of FIG. 9, an offset external plate 102 and a rotating, symmetric internal structure 108 provide radial and circumferential positioning. The internal structure attracts or repels the focal spot generally along a vector through the focal spot, i.e., radially. The vector through the center of the external plate and the focal spot has both radial and circumferential components.

Figure 10:
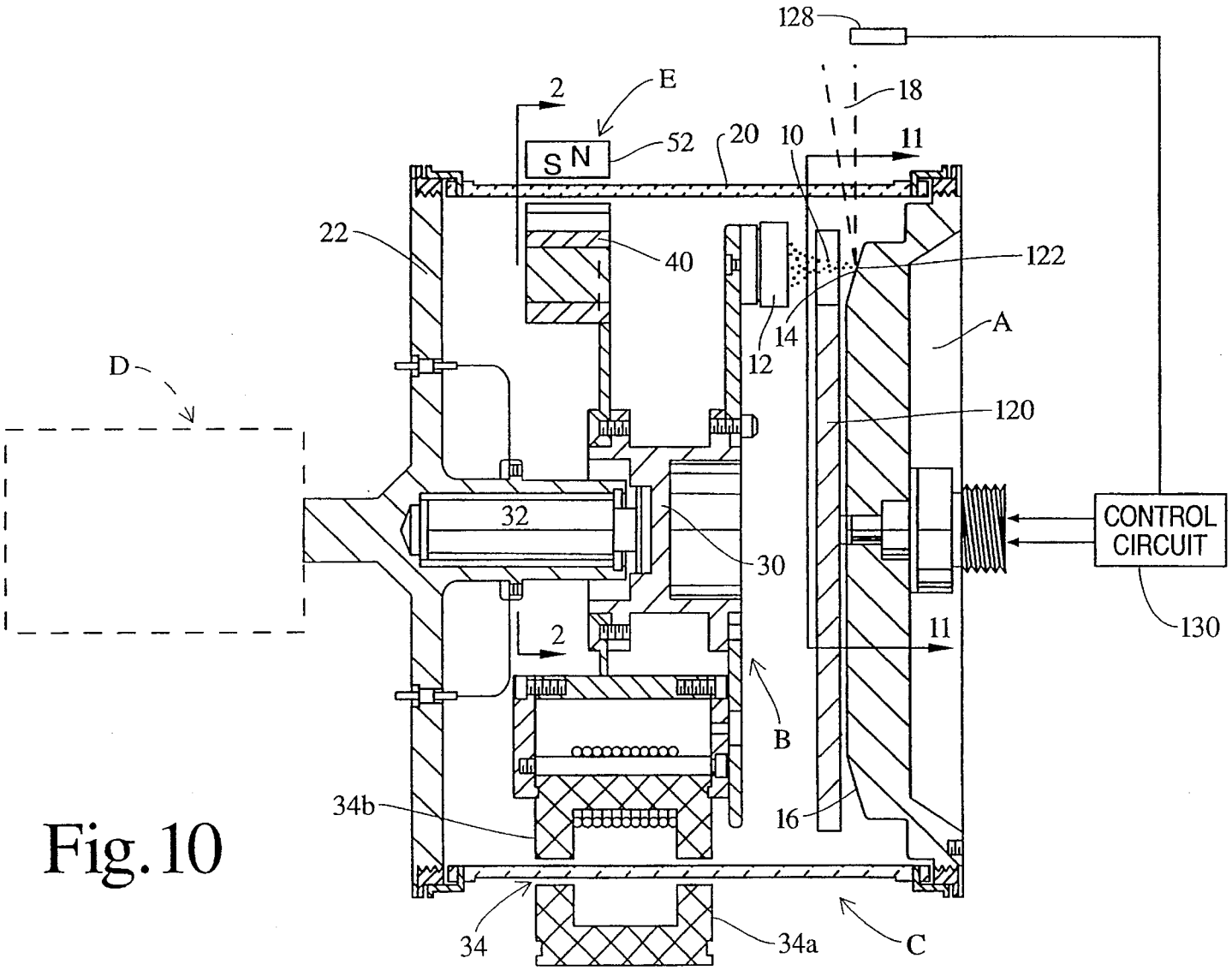
FIG. 10 is a cross-sectional view of a further embodiment of the present invention; and, FIG. 11 is a partial cross-sectional view of the x-ray tube along line 11—11 of FIG. 10.
Figure 11:
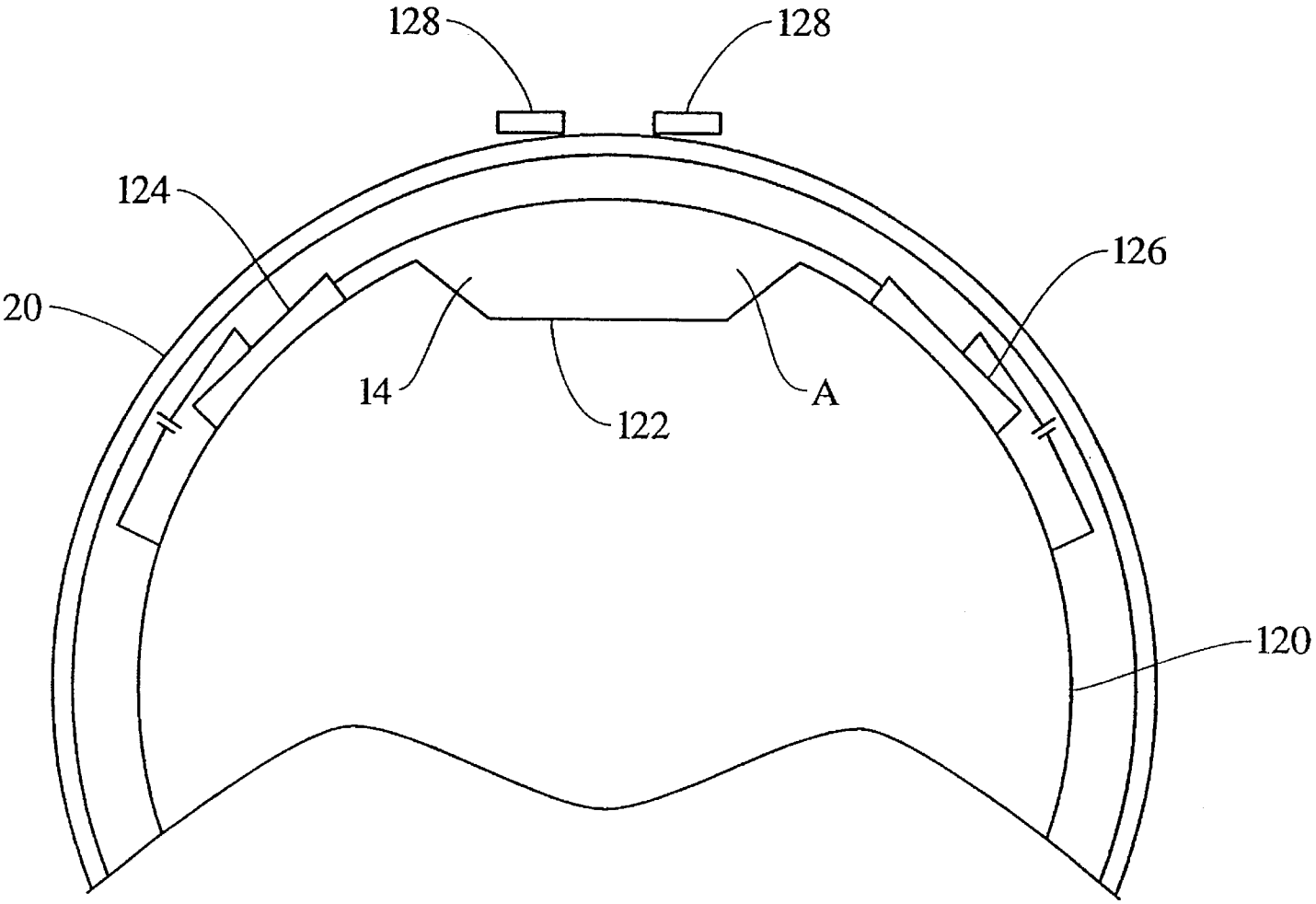

Referring now to FIGS. 10 and 11, an internal plate 120 has a port or window 122. Offset internal plates 124 and 126 are biased to exert radial and circumferential forces on the beam. To move the beam in a first direction, equal and opposite voltages are applied to the plates 124 and 126. A feedback signal is generated by using a radiation detectors 128 on each side of the port or window. As the detectors sense a shift in the radiation beam 18, a control circuit 130 adjusts the relative bias to plates 124 and 126 to shift the focal spot to the prescribed position.

The invention is also realized by manipulating magnetic fields, is opposed to electrostatic fields. Suitable magnets are used in place of electrostatic plates in such an arrangement.

Various embodiments of the invention have been detailed herein. Any combination of these embodiments is advantageously used to achieve focal spot motion control. For example, both mechanical and electrostatic assemblies are conveniently implemented in conjunction with a single x-ray tube assembly.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. In an x-ray tube assembly which includes an evacuated envelope, an anode having an annular focal spot path at one end of the envelope, a cathode which emits a beam of electrons that strike the anode at a focal spot on the focal spot path, the anode being rotated relative to the cathode such that the focal spot moves along the focal spot path, the improvement comprising:

at least one electrode external to the envelope that produces an electric field adjacent the focal spot for deflecting at least a radial position of the focal spot as it moves along the focal spot path during anode rotation.

2. An x-ray tube assembly comprising:

an evacuated envelope;

an anode disposed at a first end of the envelope for rotation about an anode axis;

a cathode assembly mounted on a cathode support structure within the evacuated envelope mounted relative to a cathode axis, the cathode assembly carrying a cathode which emits a beam of electrons which strike the anode at a focal spot, the cathode and the anode being mounted for relative rotation such that the focal spot moves around the anode along an annular path;

a collar defining a circumferential aperture at a second end of the envelope, the cathode support structure extending through the aperture;

a flexible bellows connected to the collar around the aperture and to the cathode support structure to define a flexible vacuum seal; and, an adjustment assembly for selectively repositioning the focal spot to adjust the annular path including adjustment members and adjustment and locking screws connected with the cathode support structure for adjusting a relative alignment of the cathode and anode axes to adjust the annular path followed by the focal spot.

3. An x-ray tube assembly comprising:

an evacuated envelope;

an anode disposed at one end of the evacuated envelope;

a cathode assembly mounted on a cathode support structure within the evacuated envelope, the cathode assembly carrying a cathode which emits a beam of electrons which strike the anode at a focal spot, the cathode and the anode being mounted for relative rotation such that the focal spot moves around the anode along an annular path; and, an adjustment assembly for selectively repositioning the focal spot to adjust the annular path the adjustment assembly including:

a plate disposed externally of the envelope adjacent the focal spot; and a control circuit which selectively impresses a charge on the plate to vary electric fields adjacent the focal spot.

4. The x-ray tube assembly as set forth in claim 3 further including an electrode disposed within the envelope and connected with the control circuit such that the external plate and the internal electrode act together to vary the electrical fields.

5. The x-ray tube assembly as set forth in claim 4 further including an angular position sensor for sensing the relative rotation of the cathode and the anode such that the electric field vary with the relative rotational position.

6. The x-ray tube assembly as set forth in claim 4 wherein the adjustment assembly further includes:

a second external plate disposed adjacent the focal spot, the control circuit selectively biasing the plates to shift the focal spot.

7. The x-ray tube assembly as set forth in claim 6 wherein both external plates are rotatably mounted relative to the anode such that the plates are stationary relative to the cathode.

8. The x-ray tube assembly comprising:

a cathode rotatably supported on a cathode supporting assembly;

an anode having a circumferential anode extension, the anode and cathode being rotatable relative to each other such that electrons from the cathode form a focal spot on the anode, which focal spot travels along an annular path during the relative rotation between the cathode and the anode;

an evacuated envelope connected between the cathode support and the anode;

an adjustment assembly adjustably connected with the envelope and the anode to adjust the relative orientation of the envelope and the anode, the adjustment assembly including:

an eccentric annular ring mounted between the anode extension and the envelope; and flexible bellows connected between the envelope and at least one of the anode and the annular ring to maintain vacuum after adjustment.

9. An x-ray tube assembly comprising:

a cathode rotatably supported on a cathode supporting assembly having a cathode end plate;

an anode, the anode and cathode being rotatable relative to each other such that electrons from the cathode form a focal spot on the anode, which focal spot travels along an annular path during the relative rotation between the cathode and the anode;

an evacuated envelope connected between the cathode supporting assembly and the anode;

an external bearing assembly adjustably connected with the cathode supporting assembly to adjust the relative orientation of the envelope relative to the cathode supporting assembly;

a flexible bellows connected between the envelope and the cathode end plate to maintain vacuum during and after adjustment.

* * * * *